United States Patent [19]

Barzano'

[11] Patent Number: 4,564,149

[45] Date of Patent: Jan. 14, 1986

[54] DEVICE FOR JOINING TOGETHER IN A REGISTERED AND/OR ABUTTING MANNER THE ENDS OF TWO PAPER OR CARDBOARD WEBS WHICH UNWIND FROM TWO DIFFERENT WHEELS POSITIONED ON A REEL STAR UNIT OF TWO OR MORE POSITIONS

[75] Inventor: Piero Barzano', Bergamo, Italy

[73] Assignee: IMS S.p.A., Calcinate, Italy

[21] Appl. No.: 566,339

[22] Filed: Dec. 28, 1983

[30] Foreign Application Priority Data

Jan. 7, 1983 [IT] Italy ..... 20416/83[U]

[51] Int. Cl.[4] ..... B65H 19/14; B65H 19/18

[52] U.S. Cl. ..... 242/58.1; 242/58.3

[58] Field of Search ..... 242/58.3, 58.1

[56] References Cited

U.S. PATENT DOCUMENTS

| | | | |
|---|---|---|---|
| Re. 26,528 | 2/1969 | Anderson | 242/58.3 |
| 2,236,164 | 3/1941 | Barber | 242/58.3 |
| 3,042,332 | 7/1962 | Astley | 242/58.3 |
| 3,391,877 | 7/1968 | Angell | 242/58.3 |

*Primary Examiner*—Donald Watkins
*Assistant Examiner*—Lynn M. Sohacki
*Attorney, Agent, or Firm*—Holman & Stern

[57] ABSTRACT

A device for joining together in a registered and/or abutting manner the ends of two paper or cardboard webs which unwind from two different reels (17, 19) positioned on a reel star unit (10), comprised of a presser roller spicer (36), a cutting unit (38) for cutting the web to size and at least one photoelectric reader (30) which controls the stoppage of the web from the spent reel when in proper position for joining, its joining to the new web, and the cutting to size of the last end of said spent web.

4 Claims, 4 Drawing Figures

DEVICE FOR JOINING TOGETHER IN A REGISTERED AND/OR ABUTTING MANNER THE ENDS OF TWO PAPER OR CARDBOARD WEBS WHICH UNWIND FROM TWO DIFFERENT WHEELS POSITIONED ON A REEL STAR UNIT OF TWO OR MORE POSITIONS

BACKGROUND OF THE INVENTION

1. Field of the Invention

This invention relates to a device which enables the terminal part of a paper or cardboard web unwinding from a first reel to be joined in a registered and/or abutting manner to the initial part of a web from a second reel, both the reels being positioned on a reel star. Said joint is made with great precision and with respect to previously printed, punched or sheared parts which are to be further processed.

2. Description of the Prior Art

Reel carriers which provide automatic change-over at full speed and with bonding during motion are known, and are disposed for example in line with printing machines and carry the two reels on an arm-type support which can rotate about a central shaft. Such reel carriers, known as reel stars, enable the web of a first spent reel to be replaced by the web of a new reel, by joining together the two ends by means of an adhesive tape or bonding material disposed essentially in the direction transverse to the web. Said tape is positioned on the initial part of the new reel and adheres to the final part of the spent reel, which is cut to size and pressed on the adhesive part.

However, said method does not allow a joint to be made with respect to a reference position, for printing, or for a sheared edge, as it is executed at full speed.

A very precise joint can be made on suitable devices disposed in line with the plant and provided with a so-called "magazine" which enables the joint to be made under non-moving conditions, while said magazine provides for feeding the plant for example by means of festoon unwinding zones.

BRIEF SUMMARY OF THE INVENTION

Said problems are solved by utilizing the device for bonding while in motion, combined with means for ensuring perfect registration between the two web parts which are to be joined together. This object is attained according to the invention by a device for joining together in a registered and/or abutting manner the ends of two paper or cardboard webs which unwind from two different reels positioned on a reel star unit, composed essentially of a presser roller and a unit for cutting to size the web which unwinds from the spent reel, and which are supported on arms swivelling between a rest position and an operating position which corresponds with the new reel, characterized by comprising at least one reader means which determines the stoppage under registered conditions of the web from the spent reel, its joining to the new web, and the cutting to size of the final end of said spent web.

BRIEF DESCRIPTION OF THE DRAWINGS

The structural and operational characteristics and the advantages of a device according to the invention will be more apparent from the detailed description given hereinafter of a non-limiting embodiment with reference to the accompanying drawings wherein.

Figure 1:
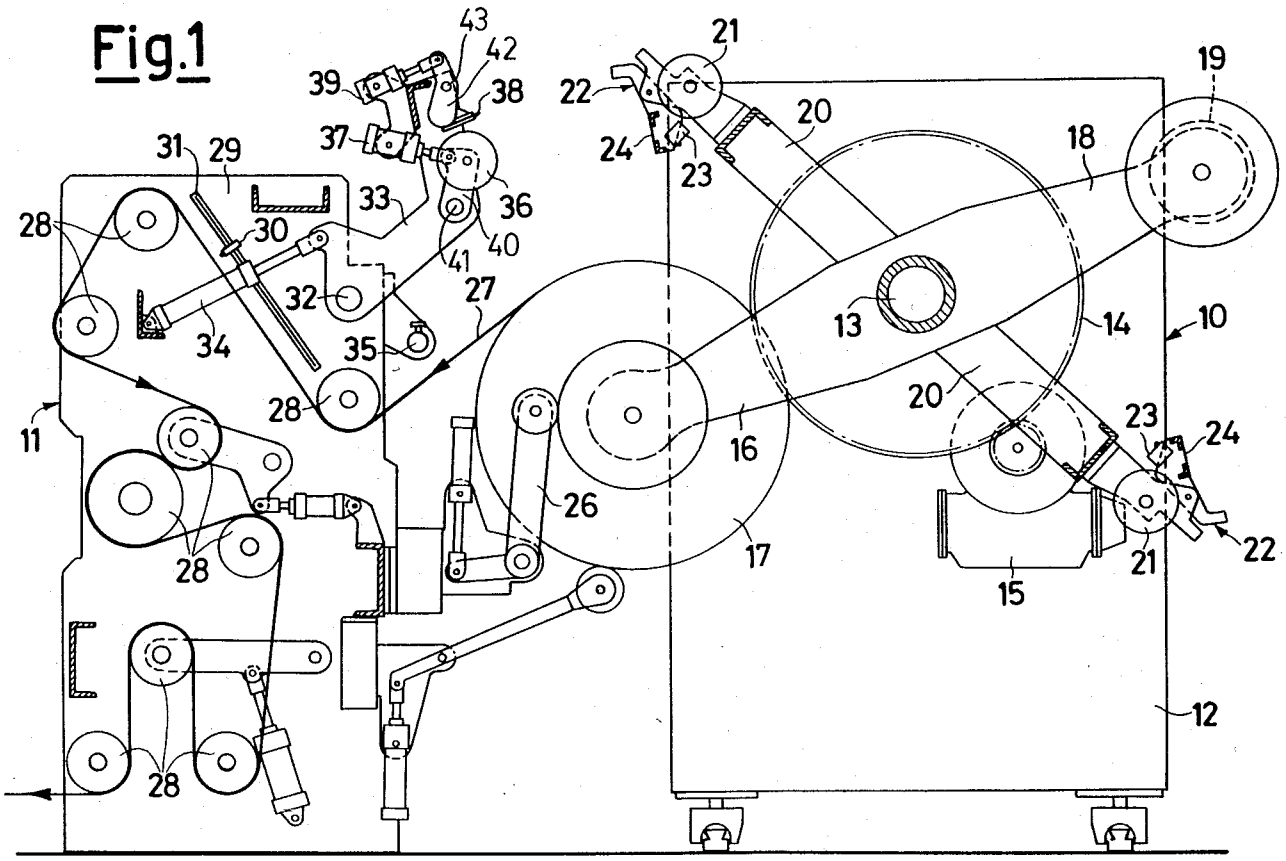
FIG. 1 is a schematic elevational view of a reel carrier provided with a device according to the invention, at the beginning of the automatic change-over of a spent reel.

With reference to the drawings, a reel star indicated overall by 10 is disposed upstream of an unwinder unit 11 which feeds a magazine and a printing machine (not shown for simplicity). Said reel star 10 is constituted by a structure 12 carrying a central shaft 13 on which there is fixed a gear wheel 14 driven by a geared motor 15.

Said shaft 13 carries a pair of arms 16 designed to support a first reel 17 and a pair of arms 18 supporting a second reel 19, for example constituted by paper or cardboard web 27. There are also provided two opposing pairs of arms 20 which swivel on the shaft 13 and carry guide rollers 21 and positionable units and brackets 22 pivotally mounted on their ends, each bracket having mounted thereon a photoelectric reading means 23 and a transverse backing blade, or counterblade 24 for cooperating with the cutter as will be later described.

Figure 3:
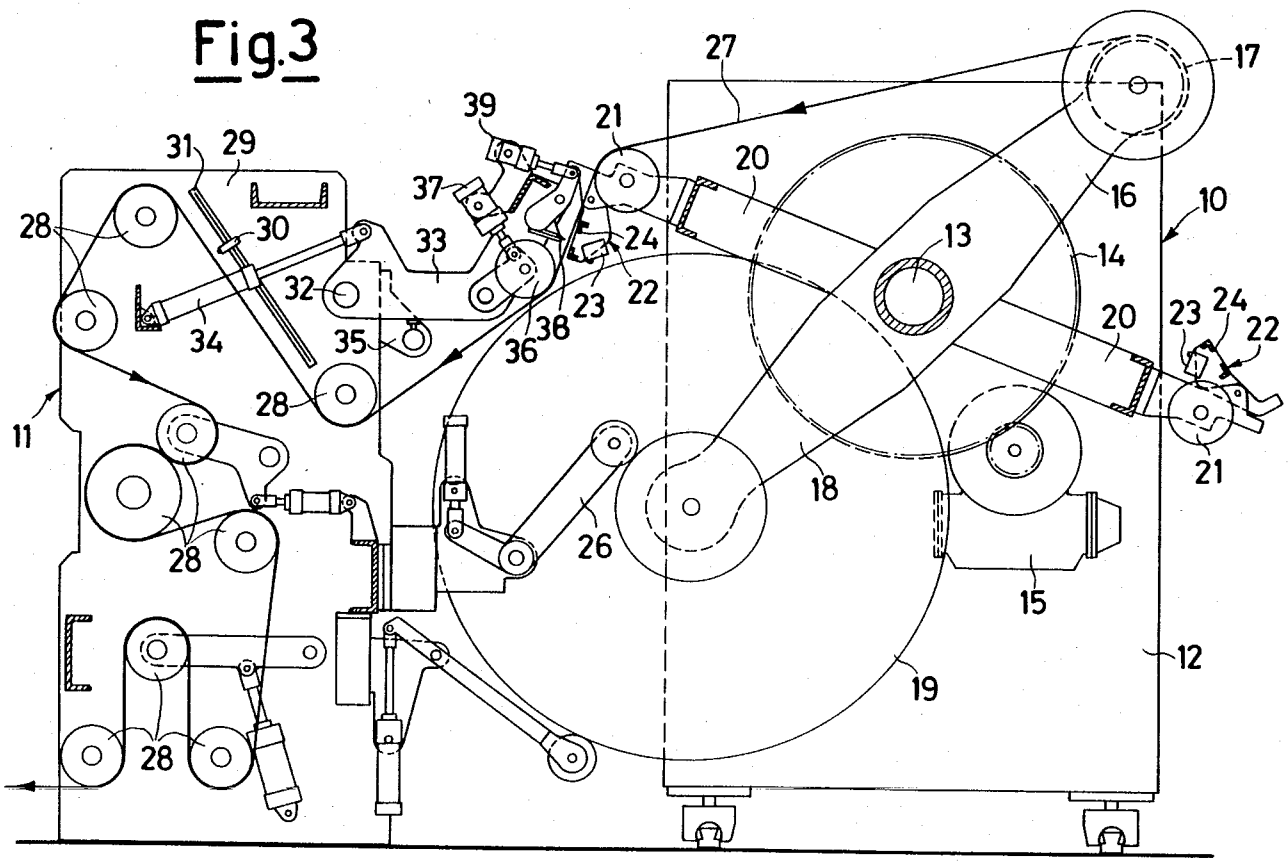
FIG. 3 shows the same view as FIG. 1, with the new reel ready for joining.
Figure 4:
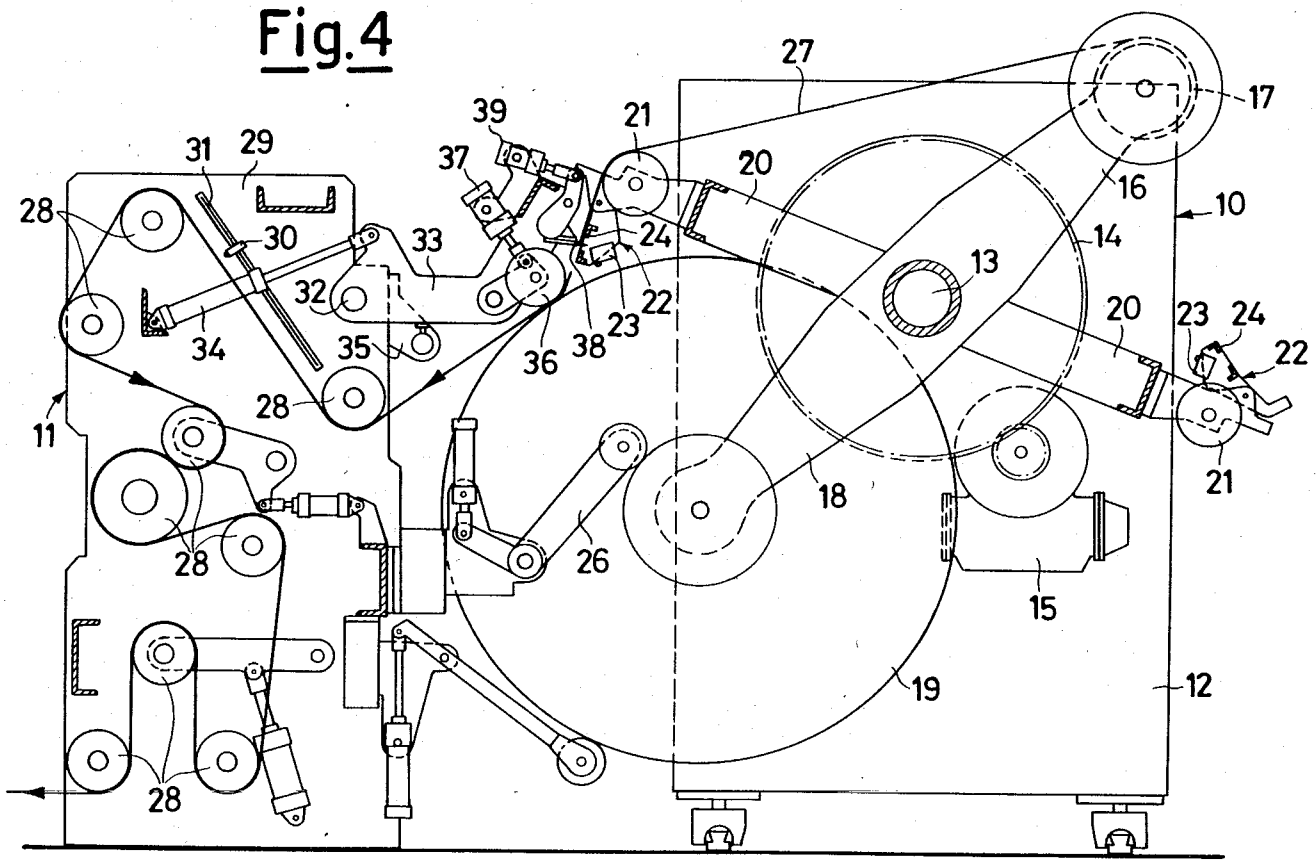
FIG. 4 shows the same view as FIG. 1, during the joining stage.

At the reel 19, as shown in FIG. 3, there is provided a drive unit 26 for positioning said reel 19, and controlled by the reader 23. The unwinder unit 11 for the reel carrier supports an entire series of rollers 28 for inserting and dragging the web 27 between shoulders 29 and a photoelectric reading means 30 which is adjustable is position on a slide guide 31 disposed in a position corresponding with the web 27.

It also carries pivoted at 32 a pair of angle arms 33 which are made to swivel, by a pair of cylinders 34 connected to the machine, between a non-operating raised position and an operating position against adjustable stops 35.

Said pair of arms 33 carries a presser, or splicing roller 36 rotatably mounted on lever 40 pivotally mounted at 41 on arms 33 and operated by respective cylinders 37, and a transverse cutting unit 38 mounted on lever 42 pivotally mounted at 43 and operated by cylinders 38 and arranged to cooperate with the backing blade 24 in order to cut the web 27. Said cutting unit could be either of the plunging type or of the shuttle type.

Figure 2:
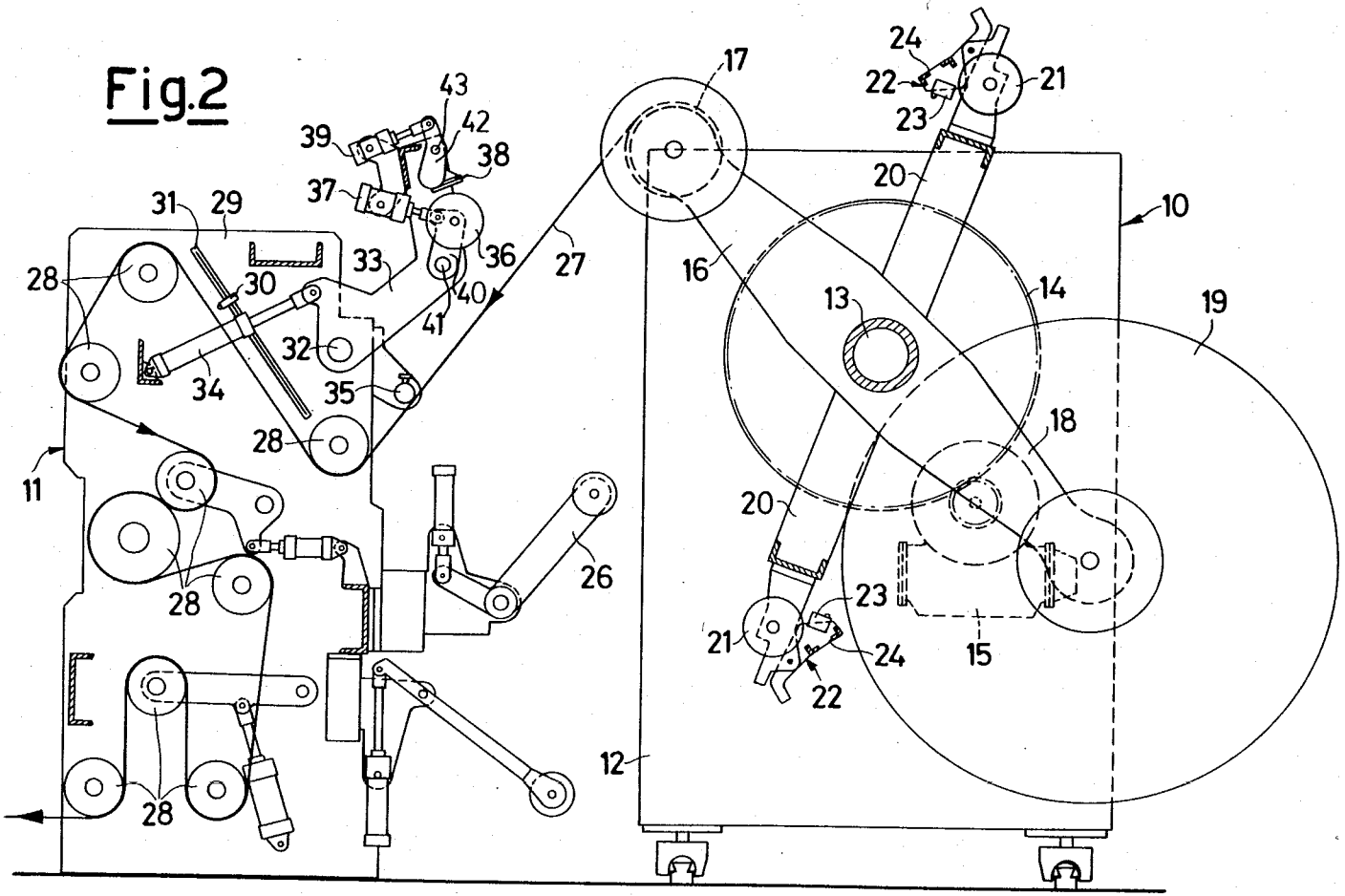
FIG. 2 shows the same view as FIG. 1 during the loading of the new full reel.

The operation of the device according to the invention is as follows. The reel 17, carried by the arms 16 and about to be spent (FIG. 1), is rotated about the shaft 13 so that it becomes disposed in such a manner that a new reel 19 (FIG. 2) can be loaded on to the diametrically opposing arms 18.

The web 27 of the new reel 19 is prepared with its end cut to registered conditions and with an adhesive tape disposed transversely along the entire width of said web 27.

One half of the adhesive tape positioned in this manner projects from the cut end, its adhesive part facing the outside of the reel 19.

As an alternative, adhesive can be used directly on the edge of the reel to be joined.

At this point, the arms 18 are further rotated by the geared motor 15 by driving the gear wheel 14 fixed on to the shaft 13, so as to move the new reel 19 into a position corresponding with the joining device on the arms 33 (FIG. 3).

In this respect, operating the cylinders 34 causes the arms 33 to rotate until they make contact with the stops 35.

The web 27 of the reel 17 thus slides on the guide roller 21, on the swivel unit 22 and on the splicing roller 36, before reaching the first of the insertion rollers 28. The reel 19 is rotated until the previously predisposed adhesive part is sensed by the optical reader 23, which halts said reel 19.

The optical reader 30 has in the meantime been disposed on the guide 31 in such a manner as to sense either one step or multiple of one step on the unwinding web 27.

The joining together of the two webs of the reels 17 and 19 is effected at this point.

In this respect, the machine unwinder unit 11 decelerates until it halts when the optical reader 30 senses the relative stop.

The cylinders 37 lower the presser, or splicing roller 36 until the web 27 of the reel 17 is brought into contact with the adhesive tape at the commencement of the underlying reel 19.

The cylinders 39 operate the transverse cutting unit 38, which by acting against the transverse backing blade, or counterblade 24 cuts the web from the reel 17 to a size such as to adhere perfectly to the underlying adhesive zone, and simultaneously returns to its rest position. At this point, the machine unwinder unit 11 starts again to rotate the full reel 19.

When bonding is complete, the presser, or splicing roller 36 rises again, pulled by the cylinders 37, and immediately afterwards the angle arms 33 are returned to their initial raised position by the cylinders 34.

A perfect joint has thus been obtained during a stoppage of just a few seconds, which can be completely insignificant if the machine is provided with a festoon "magazine" for continuous feeding and compensation.

Said joining device thus allows either bonding during motion if there are no serious register problems, or alternatively a very precise joint, merely by the provision of suitably disposed reading means.

I claim:

1. A device for joining together in a registered relationship a tail end of a first web unwound from a first reel with a lead end of a second web of a second reel, comprising:

a star reel unit having a pair of arms rotatably supporting said first reel and another pair of arms rotatably supporting said second reel;

means for rotating said star reel unit for positioning said second reel in place of said first reel when said first reel is near to expire but continues to have the first web unwound therefrom;

means for cutting said first web to provide said tail end of said first web and for splicing said tail end of said first web to said lead end of said second web comprising, cutting and splicing support arms pivotally mounted on a machine frame, means to pivotally move said cutting and splicing support arms between an inoperative position and an operative position when said first web is slowing down, a movable cutting blade mounted on said cutting and splicing support arms, a bracket pivotally mounted on said star reel unit, a counterblade mounted on said bracket for cooperating with said cutting blade when in said operative position to cut said first web, a splicing roller rotatably supported on said cutting and splicing support arms, and means operatively associated with said cutting blade and roller to actuate said cutting blade and roller to produce the cutting and splicing when said cutting and splicing support arms are in the operative position and said first web is stopped;

means for rotating said second reel;

a first photoelectric means on said star reel unit for controlling said means for rotating said second reel for positioning said second reel in a predetermined stationary angular position in which said lead end faces said first web; and second photoelectric means responsive to register marks on said first web for controlling slowing down and momentarily stopping of said first web in a position in which said tail end of said first web is in registered joining relationship with said stationary angularly positioned lead end of said second web and for substantially simultaneously actuating said cutting and splicing means and restarting movement of said joined webs.

2. A device for joining together in a registered relationship a tail end of a first web unwound from a first reel with a lead end of a second web of a second reel, comprising:

a star reel unit having a pair of arms rotatably supporting said first reel and another pair of arms rotatably supporting said second reel;

means for rotating said star reel unit for positioning said second reel in place of said first reel when said first reel is near to expire but continues to have the first web unwound therefrom;

means for cutting said first web to provide said tail end of said first web;

means for splicing said tail end of said first web to said lead end of said second web;

means for rotating said second reel;

a first photoelectric means on said star reel unit for controlling said means for rotating said second reel for positioning said second reel in a predetermined stationary angular position in which said lead end faces said first web; and second photoelectric means responsive to register marks on said first web for controlling slowing down and momentarily stopping of said first web in a position in which said tail end of said first web is in registered joining relationship with said stationary angularly positioned lead end of said second web and for substantially simultaneously actuating said cutting and splicing means and restarting movement of said joined webs;

an additional pair of arms on said star reel unit; and a bracket movably mounted on each additional arm for movement between an inoperative position and an operative position;

said first photoelectric means being mounted on said brackets on said additional arms.

3. A device as claimed in claim 1 and further comprising:

an additional pair of arms on said star reel unit;

a said bracket being mounted on each additional arm for movement because an inoperative position and an operative position; and said first photoelectric means being mounted on said brackets on said additional arms.

4. A device as claimed in claim 3 wherein:

said cutting blade and splicing roller are mounted on separate levers pivotally mounted on said cutting and splicing support arms; and said means to actuate said cutting blade and splicing roller are pivotally mounted on said cutting and splicing support arms and operatively connected to said cutting blade and splicing roller, respectively.

* * * * *